US006923253B2

(12) United States Patent
Saheta et al.

(10) Patent No.: US 6,923,253 B2
(45) Date of Patent: Aug. 2, 2005

(54) PIVOTING GOOSENECK

(75) Inventors: Vishal Saheta, Houston, TX (US); Rod Shampine, Houston, TX (US); Yarom Polsky, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 118 days.

(21) Appl. No.: 10/231,555

(22) Filed: Aug. 30, 2002

(65) Prior Publication Data

US 2004/0020639 A1 Feb. 5, 2004

Related U.S. Application Data

(63) Continuation-in-part of application No. 10/209,697, filed on Jul. 31, 2002, now Pat. No. 6,830,101.

(51) Int. Cl.[7] ..... E21B 19/22
(52) U.S. Cl. ..... 166/77.2; 166/85.5
(58) Field of Search ..... 166/77.1–77.3, 166/85.5

(56) References Cited

U.S. PATENT DOCUMENTS

| | | | | |
|---|---|---|---|---|
| 5,279,364 A | | 1/1994 | Jantzen | 166/77 |
| 5,799,731 A | | 9/1998 | Avakov | 166/77.2 |
| 5,803,168 A | | 9/1998 | Lormand | 166/77.2 |
| D436,519 S | | 1/2001 | Shampine | D8/356 |
| 6,431,286 B1 | * | 8/2002 | Andreychuk | 166/384 |
| 6,502,641 B1 | * | 1/2003 | Carriere et al. | 166/384 |
| 6,695,048 B2 | * | 2/2004 | Andersen et al. | 166/77.2 |
| 6,763,890 B2 | * | 7/2004 | Polsky et al. | 166/360 |

FOREIGN PATENT DOCUMENTS

| | | |
|---|---|---|
| CA | 2322917 | 4/2002 |
| GB | 2 247 260 | 2/1992 |
| WO | 00/34620 | 6/2000 |

* cited by examiner

*Primary Examiner*—Zakiya Walker
(74) *Attorney, Agent, or Firm*—Steve Schlather; Tim Curington; Robin Nava

(57) ABSTRACT

A gooseneck for coiled tubing operations have a folding design to allow for a more compact design for storage and transport. The gooseneck may remain attached to the injector during transport, thereby decreasing the equipment required to move and set-up the coiled tubing equipment. The gooseneck includes a linkage mechanism for connecting a pair of support struts between the injector body and the tubing guide. The linkage allows the guide to follow a substantially parabolic path as it tracks the tubing from the reel to the injector.

15 Claims, 5 Drawing Sheets

PIVOTING GOOSENECK

CROSS REFERENCE TO RELATED APPLICATION

This application is a continuation-in-part of U.S. Ser. No. 10/209,697 filed Jul. 31, 2002 now U.S. Pat. No. 6,830,101.

BACKGROUND

1. Field of the Invention

The present invention relates generally to a gooseneck for use in coiled tubing operations. More specifically, the invention describes a pivoting gooseneck incorporating a linkage mechanism that allows for safer, more stable operation.

2. Description of the Prior Art

Coiled tubing operations typically involve at least three primary components. The coiled tubing itself is disposed on a reel and must, therefore, be dispensed onto and off of the reel during an operation. The tubing extends from the reel to an injector. The injector moves the tubing into and out of the wellbore. Between the injector and the reel is a tubing guide or gooseneck. The gooseneck is typically attached or affixed to the injector and guides and supports the coiled tubing from the reel into the injector. Typically, the tubing guide is attached to the injector at the point where the tubing enters. As the tubing wraps and unwraps on the reel, it moves from one side of the reel to the other (side to side). The gooseneck typically has a flared end that accommodates this side to side movement.

In performing a coiled tubing job or operation, the components required for the job (i.e., at least the coiled tubing reel, gooseneck and injector) are transported separately to the wellsite, thereby adding the expense of additional personnel and equipment (e.g., additional trucks). Once on site, the gooseneck must be attached to the injector. This increases set-up time and expense.

One of the drawbacks of the basic gooseneck is that the flared end restricts the side to side movement or motion that can be tolerated by the system. There is an existing modification of the basic gooseneck (known as a "pivoting gooseneck") that swivels or rotates about the centerline of the injector to allow greater side to side movement of the coiled tubing. For ease of description, the gooseneck position wherein its sides are parallel to the sides of the reel (i.e., wherein the coiled tubing is substantially centered on the reel), will be called the mean position or the zero degree position. However, the major drawback of the pivoting gooseneck is that it has a maximum potential energy at the mean position (i.e., a point on the gooseneck structure traces a path of an inverted "U" or inverted parabola as the gooseneck moves from side to side). This puts the pivoting gooseneck in unstable equilibrium. This unstable equilibrium has the tendency to push the gooseneck to either side. In certain situations, this tendency may cause the gooseneck to fall off the ends or may cause uneven or irregular motion of the tubing and/or gooseneck.

SUMMARY OF THE INVENTION

The gooseneck of the present invention overcomes the drawbacks of the prior art by having a linkage mechanism that results in a minimum potential energy at the mean position (i.e., a point on the gooseneck structure traces a substantially parabolic path as the gooseneck moves from side to side). This ensures that the gooseneck is in stable equilibrium during normal or standard operating parameters. This feature also provides the gooseneck with the tendency to return to a stable, centered position, relative to the injector and the tubing reel, as opposed to prior art devices which tended to "fall off" to the side. It should be understood that any suitable design may be used in conjunction with the present invention to allow the gooseneck to trace or maintain a substantially "upright U" path as it tracks the coiled tubing traveling onto or off of the reel.

The linkage mechanism is a four bar type, which consists of two cylinders, wherein the cylinders are each connected, at one end, to one comer of a triangular plate. The third corner of the plate is connected to the gooseneck. The triangular plate is typically positioned such that the third corner (i.e., a point on the gooseneck structure) traces a path of an upright "U" as the gooseneck rotates or pivots about to accommodate movement of the tubing as it feeds onto or off of the reel. The rotation of the gooseneck about the center of the injector is typically facilitated by a suitable bearing or other connector on the injector. The triangular plate may slide between two mounting plates, which are also connected or attached to the gooseneck itself.

Another useful feature of the present gooseneck is the incorporation of an overload protection system or mechanism. The system minimizes the possibility of catastrophic failure in the event the gooseneck is overloaded, thereby improving the safety of the coiled tubing operation. The system typically includes relief valves mounted on the cylinders that transfer the load from the gooseneck to the injector (i.e., the cylinders that form a part of the linkage, as previously described). The relief valves include a pressure sensing device for determining the pressure exerted in each cylinder and may be set to blow or release at a certain pressure, thereby limiting the load on the gooseneck and allowing for energy dissipation in the event of overloading.

The basic gooseneck described in the prior art is generally a one-piece structure that cannot be lowered for tool installation, storage or transportation. The gooseneck of the present invention overcomes this limitation by having a compact folding design that allows the gooseneck to be lowered for tool installation and occupy a decreased space for purposes of storage and transportation. This is achieved by retracting the main cylinders (which support the gooseneck on the injector). As the cylinders retract, the gooseneck pivots about the pin connection at the injector and the gooseneck height is lowered, thus allowing more height for tool installation. The gooseneck may also be formed from a plurality of sections, which may be hinged or otherwise attached to each other such that when the gooseneck is not in use, it may be folded to a decreased, compact size.

DETAILED DESCRIPTION OF THE PREFERRED EMBODIMENTS

Figure 1:
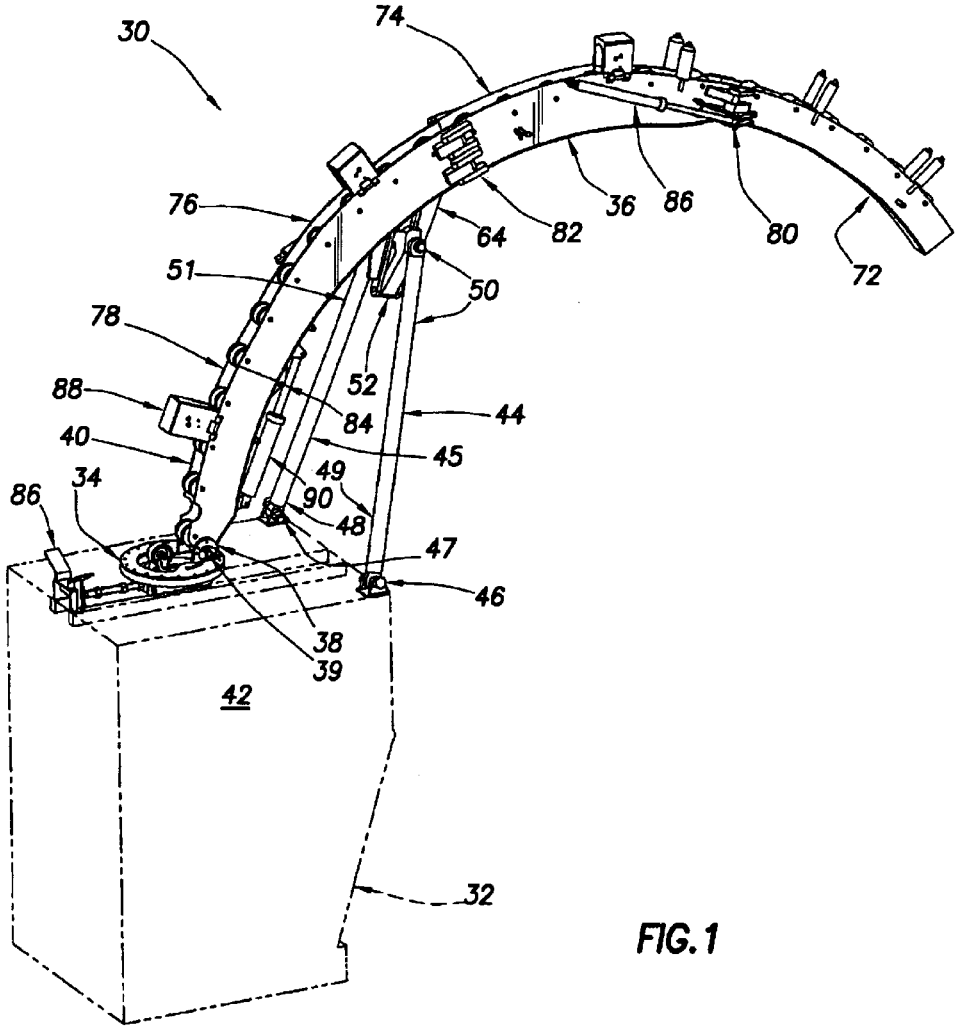
FIG. 1 is a schematic of a pivoting gooseneck.

FIG. 1 shows a gooseneck 30 in accordance with the present invention. The gooseneck 30 is shown attached or affixed to injector 32 with a mounting plate or base 34. The mounting plate rotationally supports the curvilinear tubing rail or guide 36. The guide may be attached or secured to the mounting plate using any suitable mechanism. Preferably, the mounting plate includes a turntable bearing that is provided with a pair of ears or tabs 38 which correspond to holes formed in the "injector" or lower end 40 of the guide 36. Although any suitable fastening device may be used to connect or join the guide to the mounting plate, bolts 39 are preferred.

Figure 2:
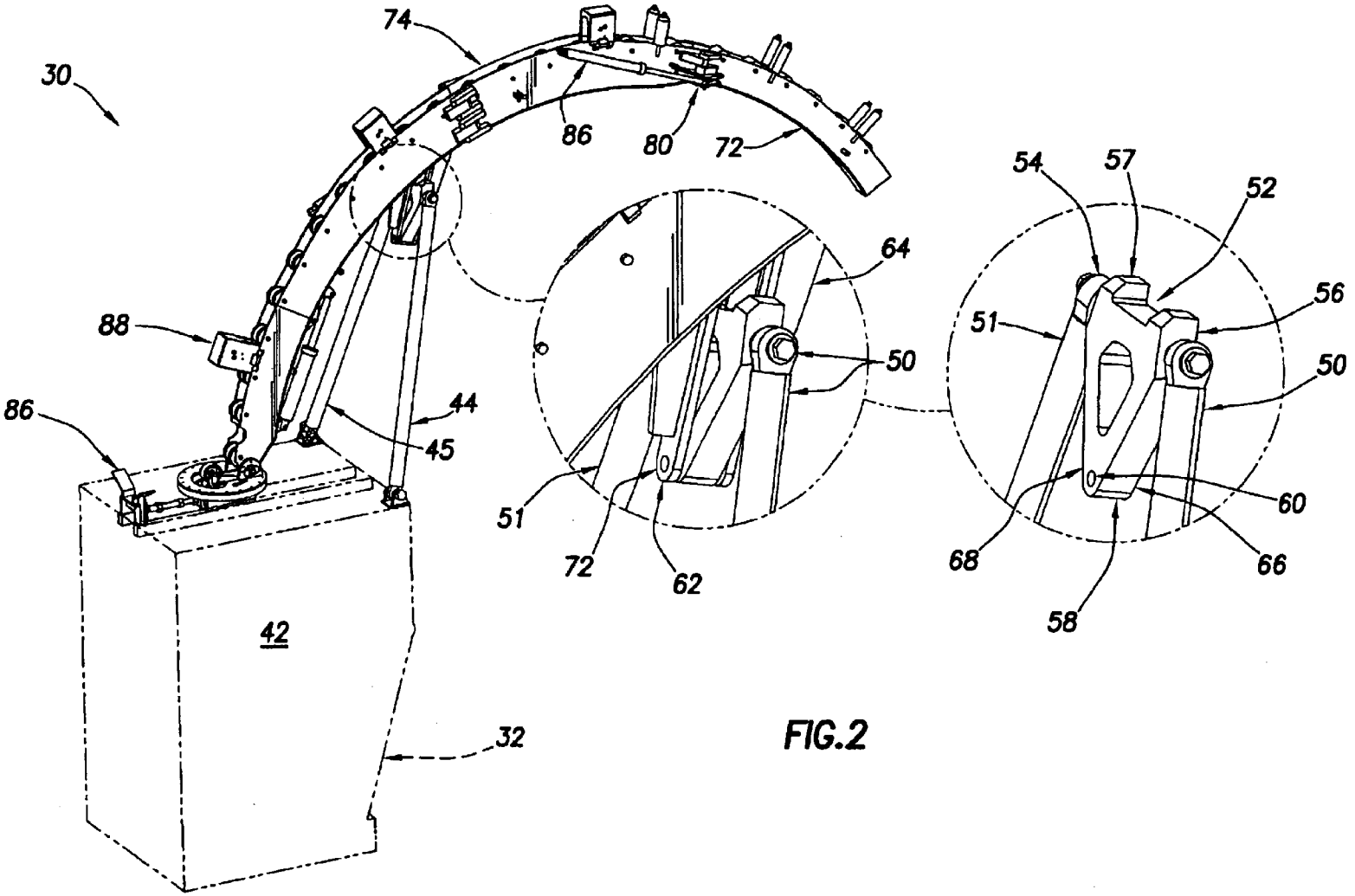
FIG. 2 is a schematic of the linkage mechanism of the pivoting gooseneck.

A pair of struts or cylinders 44, 45 are disposed between the injector or injector housing 42 and the guide 36. The injector housing preferably includes a pair of strut mounting brackets 46, 47 thereon for accepting the corresponding lower ends 48, 49 of the struts. The lower ends 48, 49 of the struts may be fastened or mounted using any suitable fastener and preferably include a bearing to provide for rotation of the struts as the tubing guide rotates to track the tubing during operation. As shown in FIGS. 1 and 2, the upper ends 50, 51 of the struts 44, 45 are each attached to a first and second corner 56, 57 of a linkage plate 52, respectively. The linkage plate may be of any suitable design or configuration but is preferably substantially triangular in shape and is preferable formed from high strength steel. The upper ends of the cylinders are preferably each provided with a suitable connector for attached or mounting the ends 50, 51 to the plate 52. In a preferred embodiment, the connector is a spherical bearing 54 that allows rotation of the upper cylinder end in three planes to accommodate movement of the guide during operation, set-up and storage/transportation. The plate is preferably oriented such that the upper struts ends are essentially parallel when the gooseneck is perpendicular to the coiled tubing reel and, when the gooseneck is in the mean position (i.e., when the gooseneck is substantially centered in relation to the injector and the reel) the plate is in the same plane as the plane formed by the two hydraulic cylinders. As shown in FIG. 1, the cylinders may diverge to a certain degree as they extend from the plate to the injector housing. Most preferably, the plate has a downward orientation such that the third corner 58, that is the corner not attached to a strut end, is generally directed toward the injector when the gooseneck and linkage is fully extended. A linkage mounting apparatus 60 attaches or secures the linkage plate 52 to the tubing guide 36. The mounting apparatus includes a first, upper portion 62 and a second lower portion 64. The first portion 62 is secured to the upper side 66 of the linkage plate and extends to attach to the guide rail. The second portion 64 is attached to the lower side 68 of the linkage plate. The second portion of the mounting apparatus extends from the linkage plate 52 to fasten or attach to the guide rail, proximally (i.e., closer to the injector) of the attachment point of the first portion. Both the first and second portions of the mounting apparatus are preferably welded to the guide rail, but may be attached using any suitable mechanism or fastener. An aperture or hole 70 is disposed through the third corner 58 of the mounting plate. The hole 70 corresponds to apertures 72 formed in the first and second portions 62, 64 of the mounting apparatus. A suitable fastener is provided to secure the plate between the first and second portions of the mounting apparatus. Preferably, a bushing or bearing is provided in the hole 70 to allow rotation of the triangular plate.

In operation, the triangular linkage allows side-to-side or pivoting movement of the tubing guide without changing the length of the struts. This, in turn, allows better tracking of the tubing by the guide, as the tubing feeds onto or off of the reel. In addition, the struts or cylinders may be expandable, thereby allowing height adjustment of the gooseneck or allowing a greater range of motion, as compared to fixed length cylinders. Any suitable mechanism may be used to adjust the length of the cylinders, such as hydraulic pressure, air pressure or a mechanical actuator.

The cylinders may further incorporate or include an overload protection system. The system functions to reduce the likelihood of a failure of the gooseneck and/or the cylinders by providing a mechanism for releasing or reducing pressure in the cylinders if the pressure exceeds a certain limit. Preferably, the system includes a relief valve on each cylinder. The valve may be set to release or blow before a catastrophic, overload failure can occur. In one embodiment, the relief valves may be mechanically set to release at a certain pressure. In another embodiment, the system may further incorporate a monitoring system to monitor pressure in the cylinders and open and close the relief valves as required to maintain optimal pressure in the cylinders without allowing them to reach overload. The monitoring system may also be used by personnel operating the equipment to determine cylinder pressures and modify or adjust the parameters of the operation to account for dangerous or excessive load increases on the gooseneck. Although in certain cases, it may be necessary to completely dissipate pressure in the cylinders, other cases may require that only a relatively small amount of pressure be relieved or bled off. The monitoring system may be used to either partially open a relief valve to slowly decrease pressure and/or open a valve for a limited duration of time sufficient to decrease the pressure in the cylinder to a safer level. In the event of a dangerous overload situation, however, the valves may be fully opened to relieve all of the pressure in the cylinders.

Another embodiment of the present invention is a folding design that allows the gooseneck to be stored and transported in an assembled state. In the folded or compact configuration, the gooseneck may be attached to the injector such that the gooseneck/injector combination may be transported as a single unit within typical transportation size limits.

Figure 3:
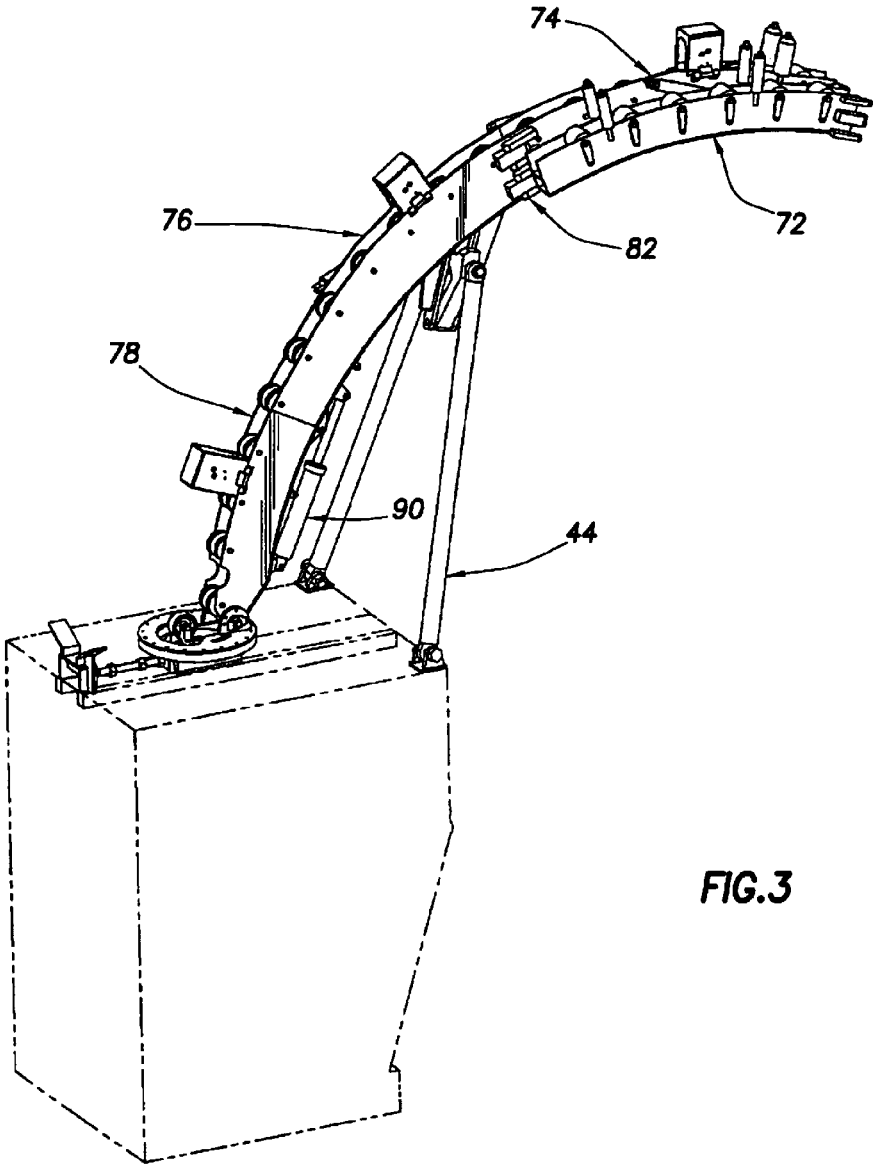
FIG. 3 is a schematic of the guide in a partially folded configuration.
Figure 4:
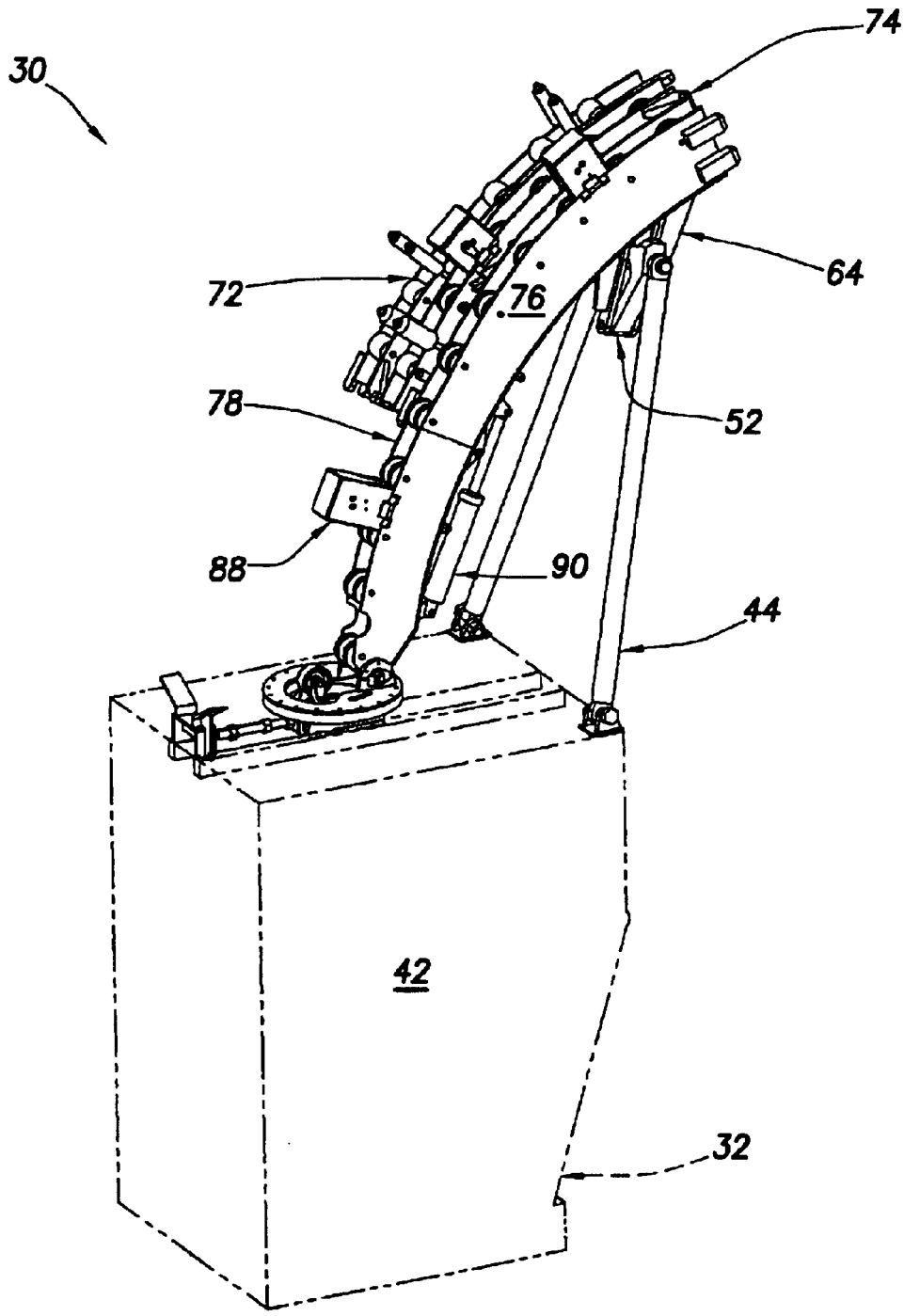
FIG. 4 is a schematic of the guide in a partially folded configuration.
Figure 5:
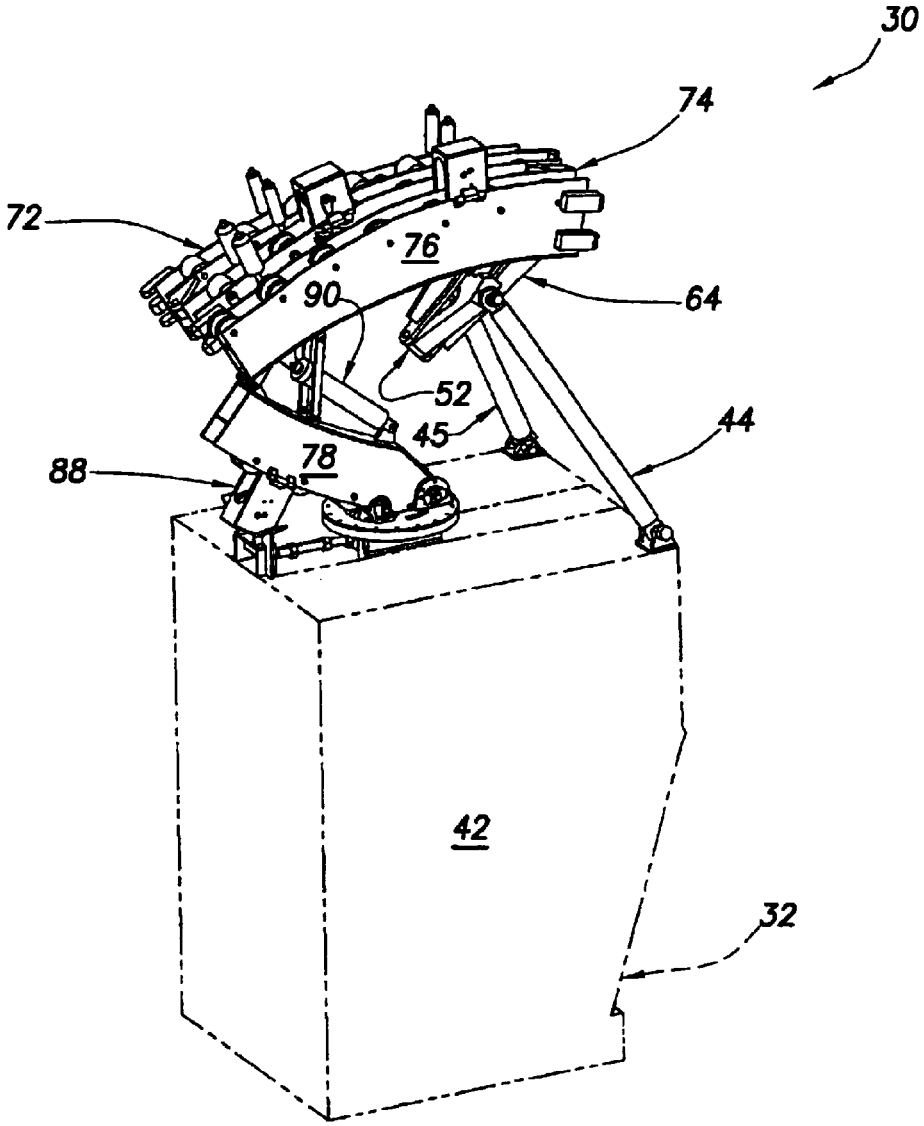
FIG. 5 shows the gooseneck in the fully folded or compact orientation.

FIG. 1 shows the gooseneck in a fully extended, work-ready form. FIG. 4 shows the gooseneck in a partially folded or retracted position. The tubing rail 36 preferably includes a plurality of curvilinear sections or components 72, 74, 76, 78 which are attached or connected to allow the gooseneck to be folded or retracted from the fully extended position. Preferably, the sections are connected with hinges 80, 82, 84. In one embodiment, and as shown in FIGS. 3–5, the hinges permit section 72 to fold or swing back until it is adjacent to and parallel with section 74. A cylinder or piston 86 may be used to actuate the folding of section 72; however, any suitable method or mechanism may be used to actuate the section. FIG. 3 shows a gooseneck having section 72 in a folded or compact position.

Similarly, and as shown in FIG. 4, section 74 is hingedly connected or attached with hinge 82 to section 76. An actuator is provided to move or fold the section 74 until it is substantially adjacent and parallel to section 76. Preferably, the actuator is a cylinder or piston, such as that used to actuate section 72. Typically, section 72 is folded against section 74 prior to section 74 being folded against section 76. In a preferred embodiment, the triangular linkage 52 is attached or connected to section 76.

As shown, the hinges 80, 82 allow the substantially horizontal folding of sections 72 and 74. FIG. 5 shows the gooseneck in a final, folded position or configuration, such that it could be easily and efficiently stored or transported.

Section 76 is hingedly attached to section 78 with hinge 84. The hinge 84 is preferably positioned such that section 76 folds in a substantially downward manner, on top of section 78. To facilitate the folding operation of section 76, section 78 may be pivoted at the mounting plate 34. Depending on the particular configuration of the gooseneck and the transportation or storage requirements that must be met, section 76 may not be folded completely onto section 78. Similarly, section 78 may not be folded completely onto the injector housing 42.

In a preferred embodiment, a gooseneck support mechanism 86 is disposed on the injector housing 42. The support mechanism preferably accepts or supports tubing retainer 88 when section 78 is moved to a folded or compact position. The mechanism provides support for the gooseneck and prevents it from directly contacting the injector housing. The mechanism further prevents rotation of the folded gooseneck during transportation.

In operation, the gooseneck is preferably folded or unfolded/deployed using a plurality of hydraulic cylinders or actuators. Although any suitable combination of folds may be used to compact the gooseneck, a preferred embodiment utilizes a side folding configuration for sections 72 and 74 and a transverse fold for section 76. That is, sections 72 and 74 are folded so that they along an axis generally parallel to the gooseneck and section 76 is folded along an axis generally perpendicular to the gooseneck.

The compact design of the present folding gooseneck allows it to be transported or stored in a substantially smaller space than previous gooseneck designs. In a preferred embodiment, the gooseneck may by stored or transported attached or connected to the injector. This decreases the amount of transport vehicles required for equipment and also decreases the time required for set-up or breakdown of the equipment at the wellsite.

While certain features and embodiments of the invention have been shown in detail herein, it should be recognized that the invention includes all modifications and enhancements within the scope of the accompanying claims.

We claim:

1. An apparatus for guiding coiled tubing between a reel and injector comprising:

(a) a first extension section having a proximal end and a distal end; and (b) a mounting section having a first end and a second end, said first end being hingedly attached to said injector, wherein said proximal end of the extension section is hingedly attached to the second end of said mounting section such that the first extension section can be folded in a plane substantially parallel to the mounting section.

2. The apparatus of claim 1, further comprising at least an additional extension section having a first end and a second end, wherein said additional extension section is hingedly attached to said first extension section.

3. The apparatus of claim 2, further comprising two additional extension sections, each having a proximal end and a distal end and wherein said one of said additional extension sections is attached, at it's proximal end, to the distal end of the first extension section and wherein the other of said additional extension sections is attached, at it's proximal end, to the distal end of the first of said additional extension sections.

4. The apparatus of claim 3, wherein the additional extension sections are provided with a hinge mechanism at their proximal and distal ends.

5. The apparatus of claim 2, wherein said at least one additional extension section can be folded in a plane perpendicular to the mounting section.

6. The apparatus of claim 1, wherein said mounting section is rotatably attached to the injector.

7. The apparatus of claim 1, further comprising an actuator for moving the first extension section from an extended position to a folded position.

8. The apparatus of claim 1, wherein the first end of the mounting section is rotatably attached to the injector.

9. The apparatus of claim 1, wherein the apparatus is transported attached to the injector.

10. The apparatus of claim 9, wherein the injector and apparatus conform to standard transportation size limits.

11. An apparatus for guiding coiled tubing between a reel and an injector comprising:

a) a mounting section having a proximal end and a distal end, said proximal end of the mounting section rotatably mounted to the injector;

b) a first extension section having a proximal and distal end, wherein said proximal end is hingedly attached to the distal end of said mounting section such that the first extension section can be folded in a plane substantially parallel to the mounting section;

c) a second extension section having a proximal end and a distal end, wherein said proximal end is hingedly attached to the distal end of said first extension section; and d) a third extension section having a proximal and a distal end, wherein said proximal end is hingedly attached to the distal end of said second extension section.

12. The apparatus of claim 11, wherein the first, second and third extension sections are hinged to fold in a plane substantially parallel to a path traveled by the coiled tubing.

13. The apparatus of claim 11, wherein the first second and third extensions can move between a fully extended position, wherein the extensions are positioned in an end to end manner, and a fully compacted position, wherein the extensions are positioned in a side-by-side arrangement.

14. The apparatus of claim 11, wherein the apparatus is transported attached to the injector.

15. The apparatus of claim 14, wherein the apparatus and injector conform to standard transportation size limits.

* * * * *